US005950059A

United States Patent [19]

Sahara

[11] Patent Number: 5,950,059

[45] Date of Patent: Sep. 7, 1999

[54] COLOR IMAGE FORMING APPARATUS

[75] Inventor: Hiroshi Sahara, Susono, Japan

[73] Assignee: Canon Kabushiki Kaisha, Tokyo, Japan

[21] Appl. No.: 09/154,516

[22] Filed: Sep. 16, 1998

[30] Foreign Application Priority Data

Sep. 19, 1997 [JP] Japan ..... 9-255460

[51] Int. Cl.[6] ..... G03G 15/01; G03G 21/00

[52] U.S. Cl. ..... 399/303; 399/302; 399/299

[58] Field of Search ..... 399/303, 299, 399/306, 312, 302, 308

[56] References Cited

U.S. PATENT DOCUMENTS 5,600,421 2/1997 Takekoshi et al. ..... 399/66

5,749,034 5/1998 Folkins ..... 399/303

5,845,188 12/1998 Fujii et al. ..... 399/390

*Primary Examiner*—Richard Moses

*Attorney, Agent, or Firm*—Fitzpatrick, Cella, Harper & Scinto

[57] ABSTRACT

The present invention provides a color image forming apparatus for forming an image by transferring toner images in a superimposed fashion, comprising a plurality of electrophotographic photosensitive members, process means for forming the toner images on the photosensitive members by using color toners, a belt moved along an endless path and used for successively transferring the toner images formed on the photosensitive members, a plurality of rollers for maintaining the belt in a tension condition, and an oscillation motor attached to a drive shaft of a drive roller among the plurality of rollers, whereby transfer deviation in toner multi-transfer processes is prevented.

19 Claims, 7 Drawing Sheets

COLOR IMAGE FORMING APPARATUS

BACKGROUND OF THE INVENTION

1. Field of the Invention

The present invention relates to a color image forming apparatus of electrostatic recording type or of electrophotographic recording type, and more particularly, it relates to a color image forming apparatus having an endless belt convey mechanism used with a transfer material convey member or an intermediate transfer member.

2. Related Background Art

In image forming apparatuses such as copying machines, printers and the like, an electrophotographic system has widely been used. An image forming apparatus of electrophotographic recording type includes an image forming portion in which a latent image is formed on a photosensitive drum (image bearing member) by utilizing light, magnetism or charges and the latent image is visualized as a visualized image (toner image), a transfer material convey means for conveying a transfer material to a transfer position of the image forming portion, and a fixing device for fixing the image transferred to the transfer material onto the transfer material.

A belt-shaped convey member or transfer material convey belt is used as the transfer material convey means in view of convenience of conveyance, so that the transfer material can be conveyed to the transfer position and further to the fixing device. In this case, the transfer material is held on the transfer convey belt by an electrostatic absorbing force. The transfer material convey belt is wound around and supported by a drive roller and at least one driven roller so that the belt is moved along an endless path.

When a plurality of image forming portions are provided, the drive roller is disposed at a downstream side of a most downstream image forming portion and at an upstream side of the fixing device, and at least one driven roller is disposed at an upstream side of a most upstream image forming portion. Between the drive roller and the driven roller, the convey belt is maintained in a tension condition, so that the convey belt can be shifted at a constant speed from the most upstream image forming portion to the most downstream image forming portion without loosing between the rollers.

In the image forming portion, a roller or a blade (transfer charger) to which high voltage is applied is opposed to the image bearing member with the interposition of the transfer material convey belt and is urged against the image bearing member with the interposition of the transfer material convey belt by a biasing means. Further, as mentioned above, the transfer material (recording sheet) is electrostatically absorbed to the convey belt so that the transfer material can be conveyed to each image forming portion while being held by the convey belt positively. Then, toner images are successively transferred onto the transfer material, and thereafter are fixed to the transfer material in the fixing device, thereby obtaining a full-color image.

Recently, printers and copying machines have been made compact more and more. To this end, the transfer material convey belt, a sheet supply unit and the fixing unit have been arranged with minimum distances therebetween. However, in an image forming apparatus having such arrangement, the following problems occur.

After the transfer material is supplied from the sheet supply unit, when the transfer material leaves a pair of resist rollers (for feeding out the transfer material to a transfer unit) and reaches the transfer material convey belt, if there is a difference in rotational speed between the transfer material convey belt and the resist roller pair, the transfer material is conveyed while being pulled or pushed between the regist roller pair and the transfer material convey belt. In such a condition, immediately after a trail end of the transfer material leaves the regist roller pair, since the transfer material is conveyed with being balanced between the regist roller pair and the transfer material convey belt is suddenly conveyed only by the transfer material convey belt, abrupt change in speed occurs instantaneously. Further, in the same reason, when a tip end of the transfer material enters into the fixing device (fixing roller), abrupt change in speed occurs in the transfer material.

FIG. 6 is a graph showing a relation between time and a speed variation wave form when the speed variation of the transfer material being conveyed by the transfer material convey belt is measured by a laser Doppler velocimeter. In FIG. 6, a portion "a" shows abrupt speed variation. Such abrupt speed variation of the transfer material leads to poor image such as color deviation or formation of stripes.

Accordingly, in order to prevent the abrupt speed variation from affecting an influence upon the image, in the past, there has been proposed a technique in which a distance between a regist roller pair and a first image forming portion is selected to become greater than a length of the transfer material so that after the transfer material leaves the regist roller pair, the transfer material enters into the first image forming portion for forming a color image. Further, when a distance between a fourth image forming portion (last image forming process in the color image formation) and a fixing roller is also selected to become greater than the length of the transfer material, an influence is not affected to the image.

However, the above technique is contradictory to compactness of the image forming apparatus, and the provision of mechanism for releasing the regist rollers makes the image forming apparatus bulky.

On the other hand, it is considered that the reason why the abrupt speed variation of the transfer material is that a restraining force of a DC motor (drive source) is weak with respect to a shaft of the drive roller for the transfer material convey belt. However, in the past, since the output shaft was restrained by an electromagnetic force in the DC motor, non-steady state disturbance such as the above-mentioned abrupt speed variation could not be restrained adequately (inherent rotational speed cannot be maintained, and the output shaft is rotated by the influence of disturbance).

Further, as shown in FIG. 5, when an output shaft 143*a* of a DC motor 143 is drivingly connected to a shaft 145 of a drive roller for a transfer material convey belt 124 via timing belt 142, due to tolerance of mechanical elements disposed between the shaft of the drive roller and the output shaft of the DC motor, the restraining force is further weakened. Incidentally, the reference numerals 62, 63 denotes a transfer frame; 61*a*, 61*b* denote bearings.

SUMMARY OF THE INVENTION

An object of the present invention is to provide an image forming apparatus which can solve the above-mentioned problems and which has an endless belt convey mechanism that is strong to non-steady state disturbance and that is used with a transfer material convey member or an intermediate transfer member.

To achieve the above objects, according to the present invention, there is provided a color image forming apparatus for forming an image by transferring toner images in a superimposed fashion, comprising a plurality of electrophotographic photosensitive members, process means for forming the toner images on the respective photosensitive members by using color toners, a belt moved along an endless path and used for successively transferring the toner images formed on the photosensitive members, a plurality of rollers for maintaining the belt in a tension condition, and an oscillation motor attached to a drive shaft of a drive roller among these rollers.

DETAILED DESCRIPTION OF THE PREFERRED EMBODIMENTS (First Embodiment)

FIGS. 1, 2, 4 and 7 show a first embodiment of the present invention.

Figure 4:
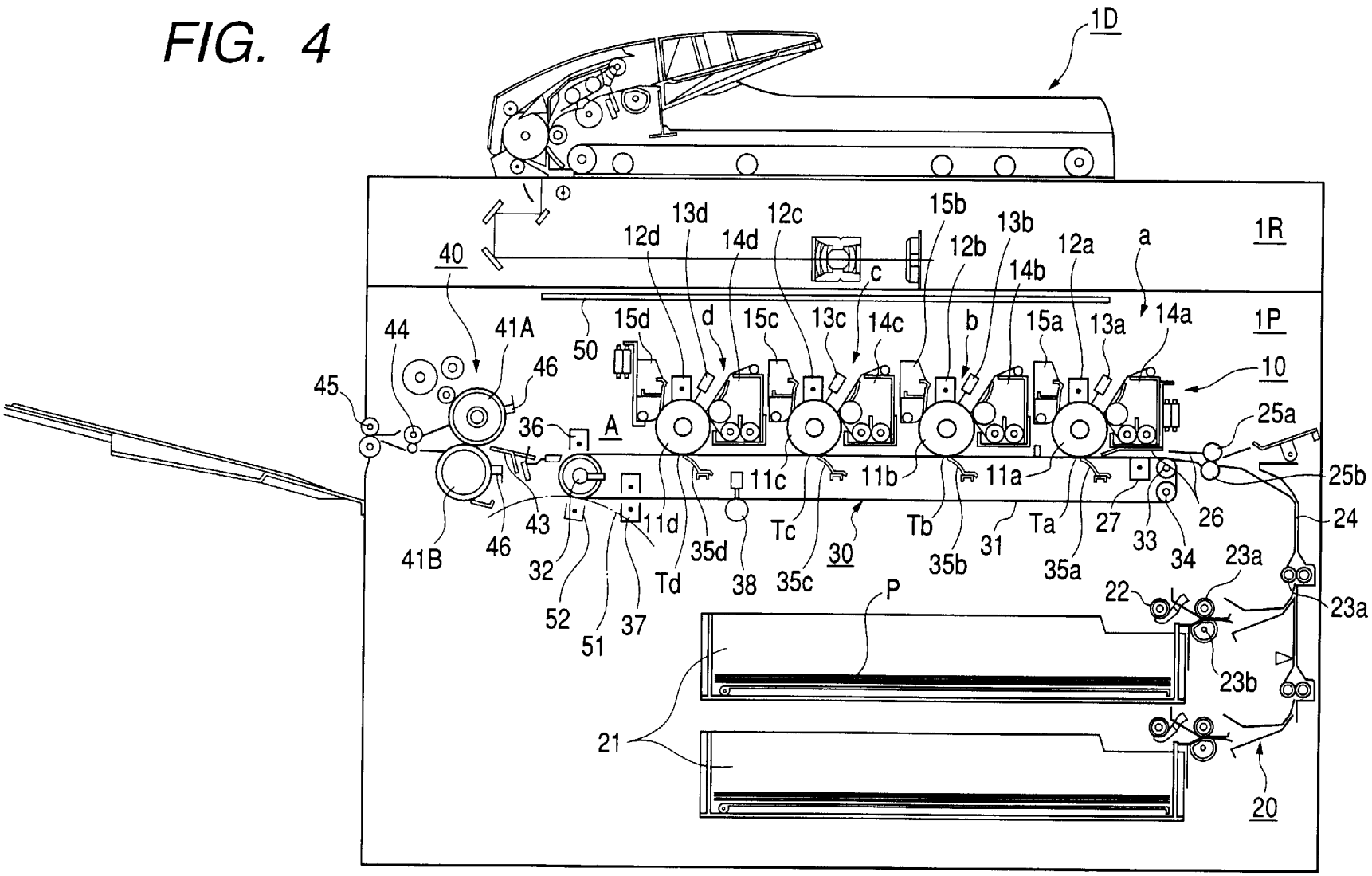
FIG. 4 is a schematic view of a full-color image forming apparatus according to the first embodiment of the present invention.
Figure 5:
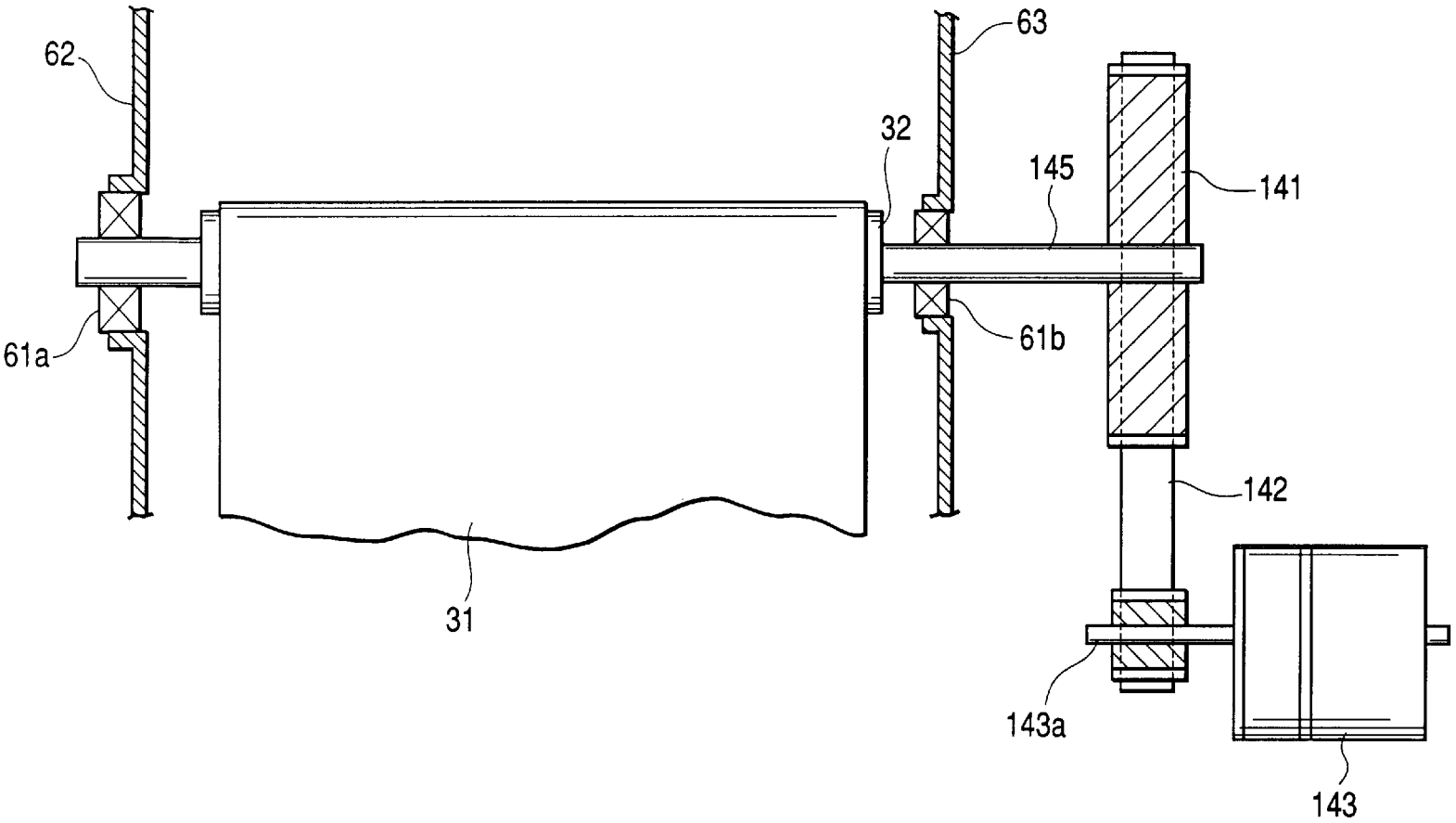
FIG. 5 PRIOR ART
FIG. 5 is a schematic view showing a drive roller (and therearound) of a conventional endless belt convey mechanism.

FIG. 4 is a main sectional view of an image forming apparatus according to the first embodiment of the present invention. Hereinbelow, as the image forming apparatus, a color image output apparatus of electrophotographic type having a plurality of side-by-side image forming portions which can be considered as particularly effective to the present invention will be explained.

An image output portion 1P is generally constituted by an image forming portion 10 (in which four identical stations a, b, c and d are disposed side-by-side), a sheet supply unit 20, a transfer material convey unit 30, a fixing unit 40, and a control unit (not shown).

Incidentally, the reference numeral ID denotes an automatic original convey device portion; 1R denotes an optical device portion for converting an image of an original in the automatic original convey device portion into an electrical signals to be illuminated onto a photosensitive drum.

Now, respective units will be fully described. The image forming portion 10 has an arrangement described hereinbelow. Incidentally, various elements in the stations a, b, c and d are designated by respective reference numerals with suffixed "a", "b", "c", "d", respectively.

In each station, an electrophotographic photosensitive drum (image bearing member) 11 is rotatably supported and is rotated in a direction shown by the arrow. Around the photosensitive drum 11, there are disposed (in order along a rotational direction thereof) a first charger 12, an optical system 13, and a developing device 14. In the first charger 12, a uniform charge amounts of charges are given to a surface of the photosensitive drum 11.

Then, by means of the optical system 13, an electrostatic latent image is formed on the photosensitive drum by illuminating light (for example, a laser beam) modulated in accordance with a recording image signal on the photosensitive drum. Thereafter, the latent image is visualized as a toner image by the developing device 14 (in the illustrated embodiment, four developing devices 14*a*, 14*b*, 14*c* and 14*d* containing four color (yellow, cyan, magenta and black) developers (referred to as "toner" hereinafter) are opposed to the corresponding photosensitive drums in the respective stations).

At a downstream side of an image transfer area T, residual toner remaining on the photosensitive drum is scraped by a cleaning device 15 to clean the surface of the photosensitive drum. By the aforementioned processes, respective toner images are successively formed.

The sheet supply unit 20 includes a cassette 21 for containing recording sheets (transfer materials) P, a pick-up roller 22 for feeding out the recording sheets from the cassette one by one, sheet supply rollers 23*a*, 23*b* and a sheet supply guide 24 for conveying the supplied sheet to a pair of regist rollers, the pair of regist rollers 25*a*, 25*b* for feeding out the recording sheet to the convey unit 30 in a timed relation to an image formation timing of the image forming portion, and a guide 26 for directing the recording sheet to the transfer material convey unit which will be described hereinbelow.

Now the transfer material convey unit 30 will be described fully. A transfer belt 31 is formed by mounting a recording sheet holding sheet (which may be made of PET (polyethylene terephthalate) or PVdF (polyvinylidene fluoride), for example) on a plurality of rollers.

An image transfer plane A is formed between a drive roller 32 and a driven roller 33, and the image transfer plane A is spaced apart from the photosensitive drums by about 1 mm. The belt drive roller 32 is constituted by coating a rubber (urethane rubber or chloroprene rubber) having a thickness of several millimeters on a metallic roller to prevent slip between the belt and the drive roller. The reference numeral 34 denotes a tension roller for applying appropriate tension to the sheet or belt 31.

An absorb charger 27 is disposed at a position where the recording sheet fed out from the pair of regist rollers 25*a*, 25*b* enters into the transfer belt 31, and transfer charge blades 35*a*, 35*b*, 35*c* and 35*d* are disposed below the transfer belt at the downstream image transfer areas T (Ta, Tb, Tc, Td) where the respective photosensitive drums are opposed to the transfer belt. Each blade can be engaged with and disengaged from the corresponding photosensitive drum by a suitable mechanism (not shown), so that, when energized, the belt is lifted and urged against the corresponding drum with proper pressure to effect good image transferring. A separation charger 36 for the recording sheet is disposed at an immediately upstream side of the drive roller 32, and an electricity removal charger 37 for applying uniform charge to the surface of the belt and a brush roller 38 for cleaning a recording sheet holding surface of the belt are disposed at a downstream side.

The fixing unit 40 includes a fixing roller 41A having a heat source (such as a halogen heater) therein, a pressure roller 41B (which also may include a heat source) urged against the fixing roller 41A, a recording guide 43 for directing the recording sheet to a nip between the rollers, and inner and outer sheet discharge rollers 44, 45 for directing the recording sheet discharged from the roller pair to the outside of the apparatus. A distance or interval (face-to-face distance) between the fixing roller and the belt drive roller is selected to become smaller than 100 mm. The control unit includes a control substrate 50 for controlling operations of the mechanisms in the various units, and a motor driver substrate (not shown).

Next, an operation of the image forming apparatus according to the illustrated embodiment will be explained.

When an image forming operation start signal is emitted, first of all, the recording sheet P is fed out from the cassette 21 by the pick-up roller 22. Then, the recording sheet is guided between the sheet supply guides 24 by means of the sheet supply rollers 23*a*, 23*b* to reach the pair of regist rollers 24*a*, 24*b*. In this case, the pair of regist rollers are stopped, and a tip end of the recording sheet abuts against a nip between the regist rollers. Thereafter, in a timed relation to the start of image formation of the image forming portion, the regist rollers start to be rotated. The timing of rotation of the resist roller pair is selected so that the recording sheet and the toner image on the photosensitive drum are aligned with each other at the image transfer area.

When the recording sheet enters into and is contacted with the transfer belt 31 being shifted by the drive roller, the recording sheet is electrostatically absorbed onto the belt by a Coulomb force under the action of the absorb charger. The transfer belt 31 is rotated in synchronous with the photosensitive drum, and the recording sheet is conveyed up to the first image transfer area Ta while being held on the transfer belt. At this area, high voltage is applied to the transfer blade 35*a* urged against the drum (at the initiation of the sequence) in a timed relation to passage of the recording sheet. The toner image formed on the photosensitive drum by the above-mentioned processes is transferred onto the surface of the recording sheet, and, thereafter, the recording sheet is conveyed to the next image transfer area, where the image formation is started with delay corresponding to time required for conveying the recording sheet between the stations. As a result, the next toner image is transferred onto the recording sheet in a superimposed fashion regarding the previous toner image. By repeating such processes, the four color toner images are multi-transferred onto the recording sheet.

After the transferring, at the separation portion, the absorbing force between the recording sheet and the holding belt (convey belt) is decreased by the action of the electricity removal charger, and then, the recording sheet is separated from the convey belt by a curvature of the drive roller.

The recording sheet separated from the transfer belt is correctly conveyed up to a transfer roller nip portion by an inlet guide 43, where the toner images are fixed to the surface of the recording sheet by heat and pressure at the nip between the pair of rollers 41A and 41B. Thereafter, the recording sheet is conveyed by the inner and outer discharge rollers 44, 45 and is discharged out of the apparatus. The transfer blades are disengaged from the corresponding photosensitive drums, and the sequence is finished in a condition that the transfer belt is spaced apart from the drums. The reason is that an external force does not act on the drums as less as possible to protect the drums.

Now, characteristic portions in the illustrated embodiment will be described with reference to FIGS. 1, 2 and 3.

Figure 1:
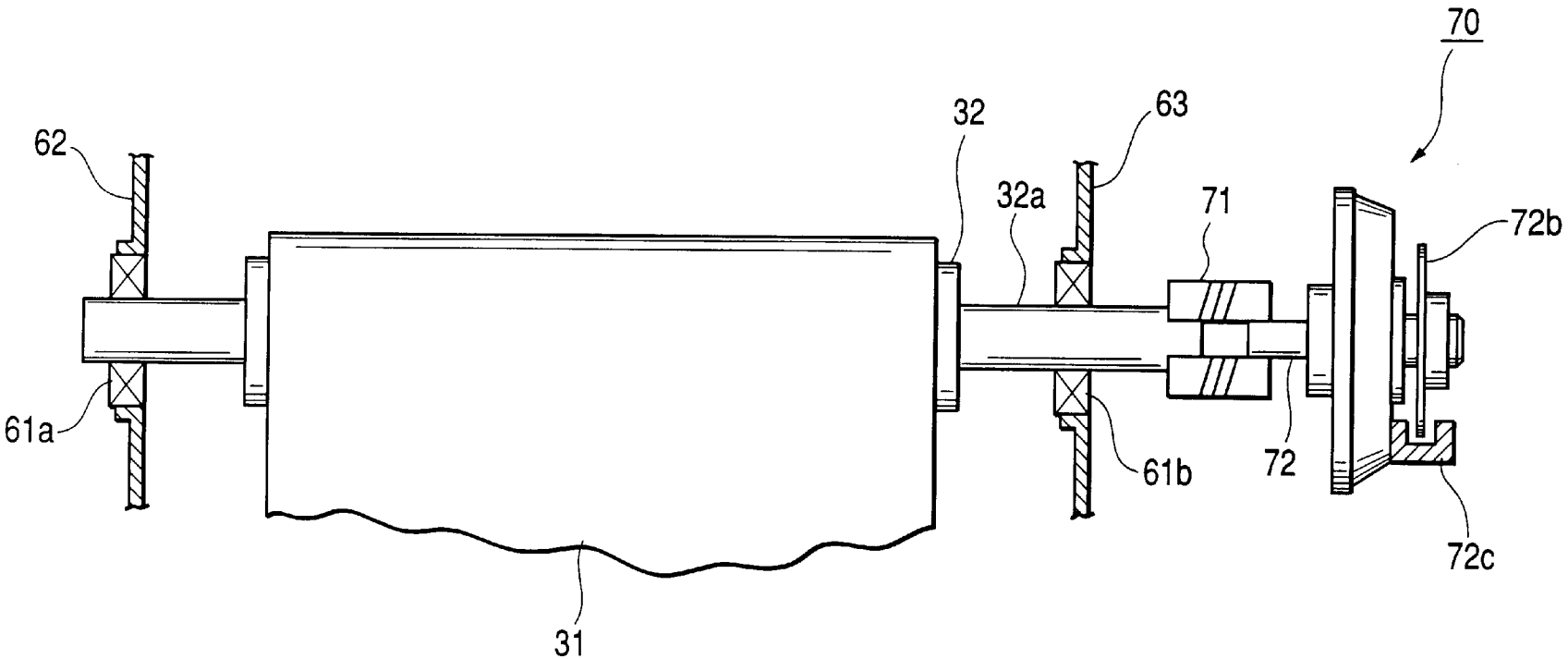
FIG. 1 is a schematic view showing a drive roller (and therearound) of an endless belt convey mechanism which is a feature of a first embodiment of the present invention.

FIG. 1 is a schematic view showing the drive roller (and therearound) of the endless belt convey mechanism which is a feature of the first embodiment of the present invention. The drive roller 32 supporting the endless belt 31 in the tension condition has a roller drive shaft 32*a* rotatably supported by bearings 61*a*, 61*b* provided on transfer frames 62, 63.

Further, one end of the drive shaft 32*a* of the drive roller 32 is coaxially connected to an output shaft 72 of an oscillation motor 70 via a coupling 71. A pulse generating plate 72*b* is secured to the other end of the output shaft 72. Further, a pulse detecting portion 72*c* secured to an outer surface of the oscillation motor cooperates with the pulse generating plate 72*b* to constitute an encode portion.

Figure 2:
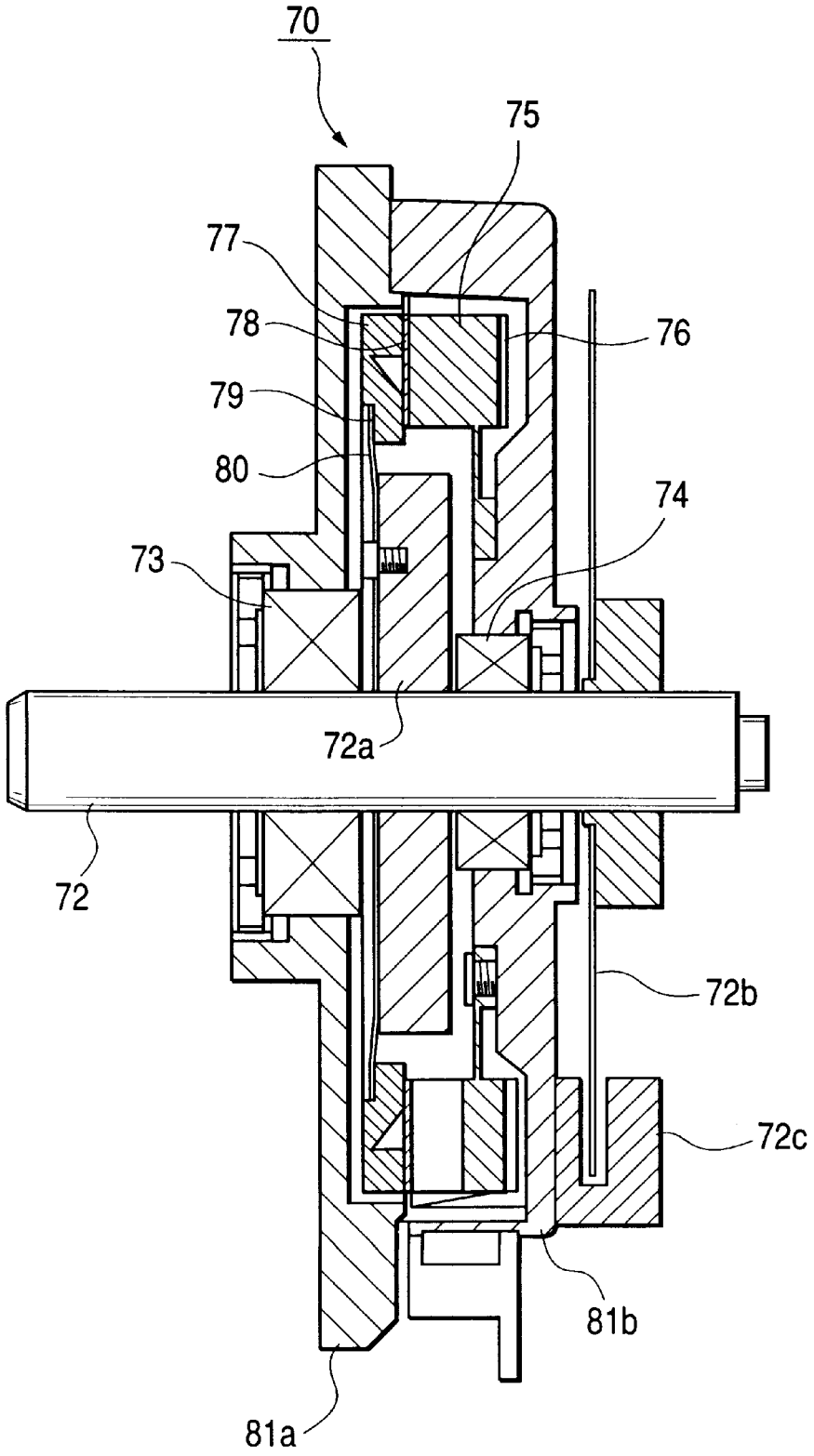
FIG. 2 is a sectional view of an oscillation motor according to the first embodiment of the present invention.

FIG. 2 shows a detailed construction of the oscillation motor 70.

In FIG. 2, the oscillation motor 70 has ball bearings 73, 74 secured to the output shaft 72 in an opposed relation, and a stator 75 is secured to the ball bearing 74. The stator 75 is formed from an elastic plate made of bronze phosphide or stainless steel, and a piezo-electric element 76 made of piezo-electric ceramic is adhered to an outer side surface of the stator.

Further, a ring-shaped rotor 77 made of aluminum is disposed in a coaxial and opposed relation to the stator 75, and an engineering plastic plate 78 is adhered to a surface of the rotor opposed to the stator 75. The engineering plastic plate 78 is contacted with the stator 75 and has a coefficient of friction for providing a stable frictional force in order to transmit a driving force to the rotor 77 with high efficiency.

A rubber sheet 79 is adhered to a surface of the rotor 77 at an opposite side of the engineering plastic plate 78, and an annular leaf spring 80 for biasing the rotor 77 toward the stator 75 through the rubber sheet 79 is secured to a flange portion 72*a* integrally secured to the output shaft 72. A peripheral portion of the leaf spring 80 abuts against the rubber sheet 79 of the rotor 77 to urge the engineering plastic plate 78 of the rotor 77 against the stator 75. Incidentally, casings 81*a*, 81*b* are provided outside the rotor 77 and the stator 75 to cover them.

With this arrangement, the output shaft 72 of the oscillation motor 70 is restrained by the frictional force between the stator 75 and the rotor 77 and is always subjected to an axial force.

In the illustrated embodiment, since the oscillation motor is used as a drive source for the transfer material convey belt and the oscillation motor is disposed in series with the drive roller for the transfer material convey belt, due to the urging force generated by the frictional force between the stator 75 and the rotor 77 and the biasing force of the leaf spring 80, the shaft of the drive roller can be restrained by a force greater than that of a DC motor. Accordingly, since the transfer material convey belt can be driven stably, poor image such as color deviation or formation of stripes caused by non-steady state disturbance such as abrupt speed variation can be prevented.

Figure 6:
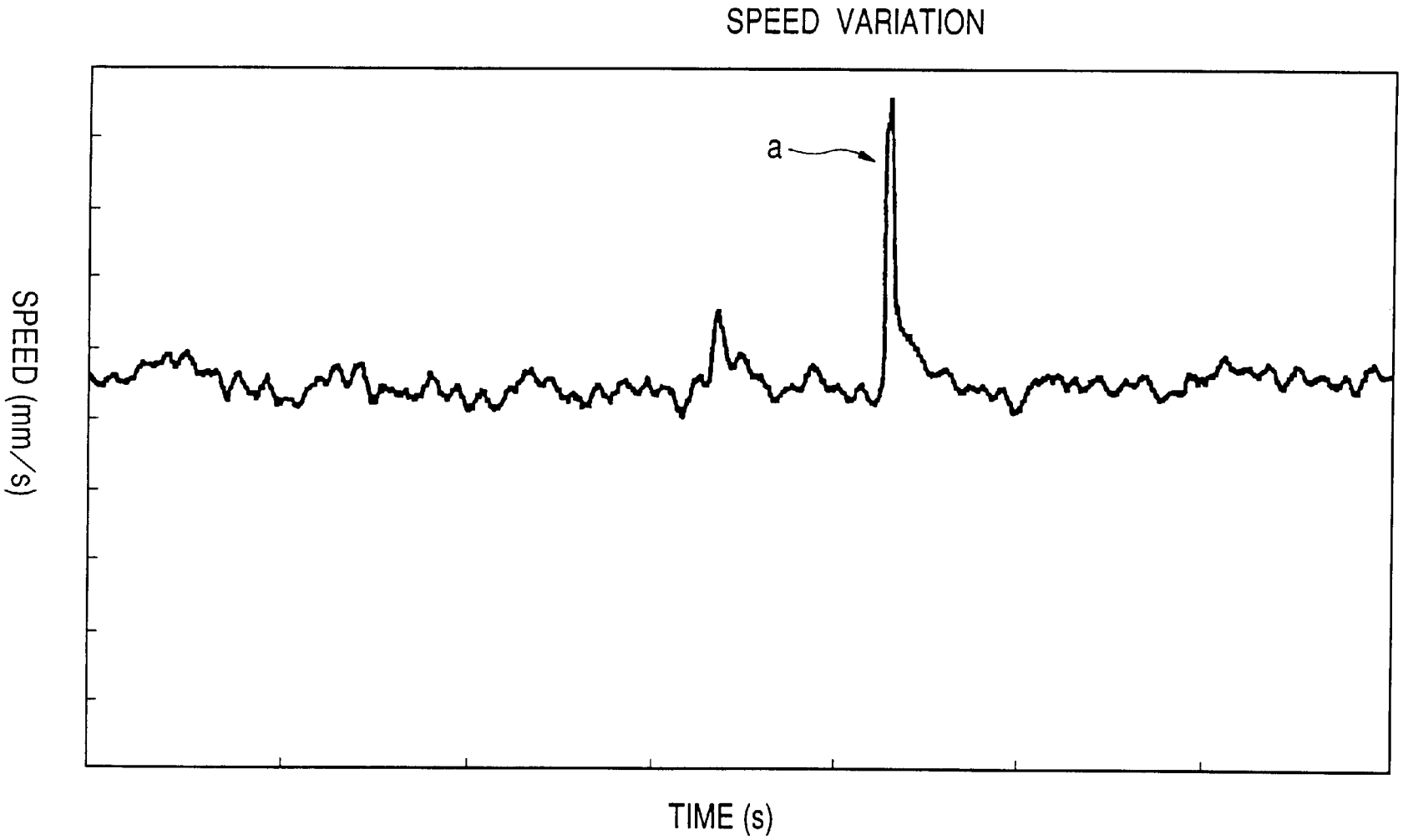
FIG. 6 is a graph showing a relation between time and a speed variation wave form of a transfer material being conveyed by a transfer material convey belt in a conventional image forming apparatus.
Figure 7:
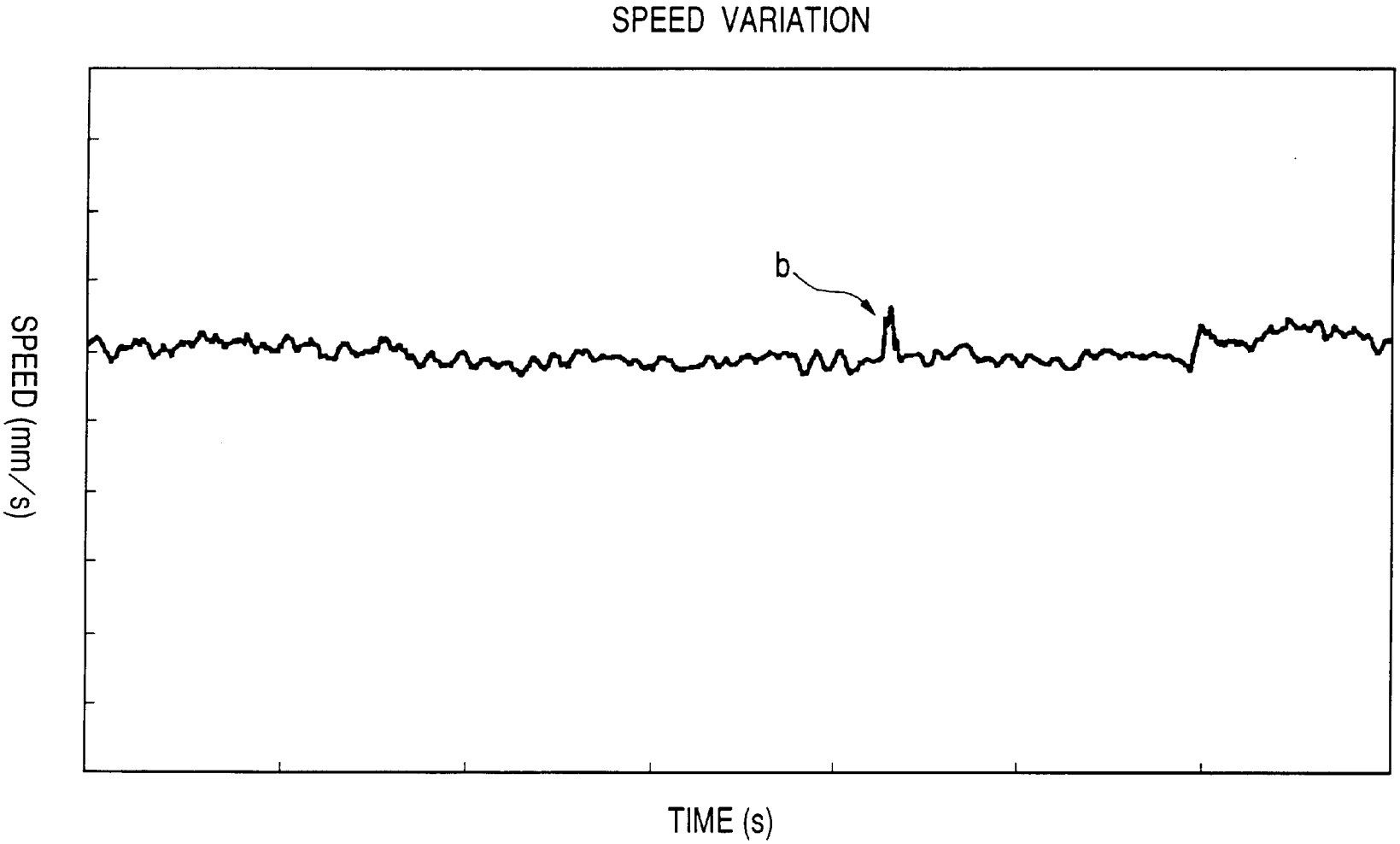
FIG. 7 is a graph showing a relation between time and a speed variation wave form of a transfer material being conveyed by a transfer material convey belt, according to the second embodiment of the present invention.

FIG. 7 is a graph showing a relation between time and a speed variation wave form when the speed variation of the transfer material being conveyed by the transfer material convey belt is measured by a laser Doppler velocimeter, in the illustrated embodiment. In FIG. 7, a portion "b" shows abrupt speed variation. In comparison with the portion "a" in FIG. 6, it can be seen that the speed variation "b" is considerably smaller than the speed variation "a".

Incidentally, since a driving principle of the oscillation motor is already known, explanation thereof will be omitted. However, A, B two-phase alternate signals such as AC voltage (drive signals) applied to an A-phase drive portion and a B-phase drive portion which have deviation between two positional phases of the piezo-electric element constituting the stator (oscillating body) of the oscillation motor are controlled on the basis of signals from the above-mentioned encoder.

The property of the oscillation motor is changed in accordance with a temperature and the like. When the belt 31 is driven at the steady state speed, in order to keep the drive speed constant, a drive control system for controlling drive frequency, a drive control system for controlling drive voltage, a drive control system for controlling a phase of a drive signal, or combination thereof may be used. Particularly when the oscillation motor is disposed in the vicinity of the fixing device 40 (which generates high temperature) as is in the illustrated embodiment, countermeasure to the temperature is desirable by utilizing the above drive control.

In the oscillation motor, the stator (oscillating body) may have annular shape, circular shape or rod shape. Further, as countermeasure to influence upon rotation due to disturbance, the greater the contact area between the rotor and the stator during the operation of the oscillation motor the stronger the restraining force of the rotor for the stator. Thus, when the number of drive waves (for example, seven waves in the oscillation motor having annular shape) generated in the stator is increased, the frictional force is increased accordingly, thereby reducing the influence of the disturbance.

(Second Embodiment)

Figure 3:
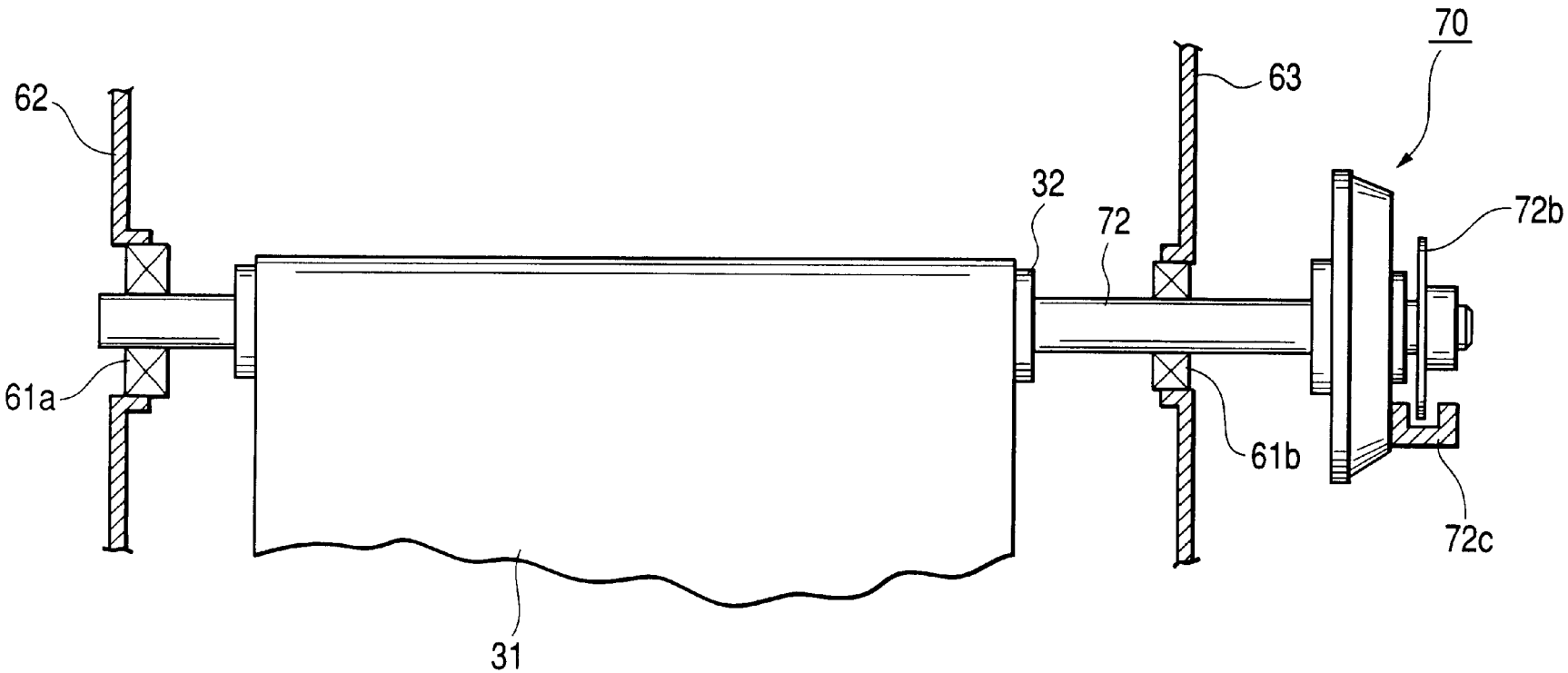
FIG. 3 is a schematic view showing a drive roller (and therearound) of an endless belt convey mechanism which is a feature of a second embodiment of the present invention.

FIG. 3 shows a second embodiment of the present invention.

FIG. 3 is a schematic view showing a drive roller (and therearound) of an endless belt convey mechanism which is a feature of the second embodiment of the present invention. Unlike to the first embodiment, the shaft of the drive roller for the transfer material convey belt and the output shaft of the oscillation motor is not interconnected through the coupling, but, as shown in FIG. 3, the drive roller shaft is integrally formed with the output shaft of the oscillation motor. In the second embodiment, since there is no mechanical element between the drive roller shaft and the output shaft of the oscillation motor, the drive roller can be restrained with a restraining force greater than that in the first embodiment.

Further, since the coupling is omitted, the number of manufacturing steps is reduced, and, thus, the manufacturing cost is reduced. In addition, since an axial width of the drive roller can be reduced, the apparatus can be made more compact.

(Third Embodiment)

In the above-mentioned embodiments, while an example that the endless belt is used for holding and conveying the transfer material was explained, the color toner images may be directly transferred onto the belt 31 and then the toner images may be transferred onto the transfer material collectively.

As a concrete embodiment, the transfer material is not supplied to a belt 31 shown in FIG. 4. After the toner images are successively transferred onto the belt directly, the toner images are collectively transferred onto a transfer material 51 (shown by the dot and chain line) by means of a transfer charger 52. After the transferring, as is in the first embodiment, the transfer material is sent to the fixing device to obtain a copied image.

Incidentally, in the above-mentioned embodiments, while an example that the developing devices utilize four color toners was explained, only three color (i.e., yellow, magenta and cyan) may be used. Further, as convey means for conveying the transfer material disposed at the upstream side, or at the downstream side, or at the upstream and downstream sides of the belt 31, a transfer material conveying device such as a convey belt may be used, as well as the regist roller pair and the fixing device.

According to the present invention, by using the oscillation motor as the drive source for the endless belt, the restraining force for restraining the shaft of the drive roller during operation can be increased due to the property of the oscillation motor. As a result, the non-steady state disturbance such as abrupt speed variation of the transfer material or the belt itself can be suppressed, thereby providing a high quality image.

What is claimed is:

1. A color image forming apparatus for forming an image by transferring toner images in a superimposed fashion, comprising:

a plurality of electrophotographic photosensitive members;

process means for forming the toner images on said photosentsitive members by using color toners;

a belt moving endlessly and used for sequentially transferring the toner images formed on said photosensitive members;

a plurality of rollers for tensioning the belt; and an oscillation motor attached to a drive shaft of a drive roller among said plurality of rollers.

2. A color image forming apparatus according to claim 1, wherein said belt is a transfer material convey belt for supporting and conveying the transfer material, and the toner images formed on said photosensitive members are sequentially transferred onto the transfer material on said belt.

3. A color image forming apparatus according to claim 1, wherein the toner images formed on said photosensitive members are sequentially transferred onto said belt, and, thereafter, the toner images are transferred onto the transfer material collectivey.

4. A color image forming apparatus according to claim 1, wherein convey means for the transfer material conveyed by another drive means is/are disposed upstream or downstream or upstream and downstream of said belt in a shifting direction of said belt.

5. A color image forming apparatus for forming an image by transferring toner images in a superimposed fashion, comprising:

a plurality of electrophotographic photosensitive members;

process means for forming the toner images on said photosensitive members by using color toners;

a belt moving endlessly and used for sequentially transferring the toner images formed on said photosensitive members;

a plurality of rollers for tensioning the belt;

an oscillation motor attached to a drive shaft of a drive roller among said plurality of rollers; and transfer means opposed to said photosensitive members disposed side-by-side in a shifting direction of said belt.

6. A color image forming apparatus according to claim 5, wherein said belt is a transfer material convey belt for supporting and conveying the transfer material, and the toner images formed on said photosensitive members are sequentially transferred onto the transfer material on said belt.

7. A color image forming apparatus according to claim 5, wherein the toner images formed on said photosensitive members are sequentially transferred onto said belt, and, thereafter, the toner images are transferred onto the transfer material collectivey.

8. A color image forming apparatus according to claim 5, wherein convey means for the transfer material conveyed by another drive means is/are disposed upstream or downstream or upstream and downstream of said belt in a shifting direction of said belt.

9. A color image forming apparatus according to claim 8, wherein said convey means for the transfer material conveyed by said another drive means disposed upstream of said belt thereof in the shifting direction is a transfer material supply means for supplying the transfer material one by one from a transfer material containing portion to said belt.

10. A color image forming apparatus according to claim 8, wherein said convey means for the transfer material conveyed by said another drive means disposed downstream of said belt thereof in the shifting direction is a convey means for conveying the transfer material separated from said belt to a fixing means disposed downstream of said belt in the shifting direction thereof.

11. A color image forming apparatus according to claim 8, wherein said convey means is a fixing device for pinching and driving the transfer material.

12. A color image forming apparatus for forming an image by transferring toner images in a superimposed fashion, comprising:

a plurality of electrophotographic photosensitive members;

process means for forming the toner images on said photosensitive members by using at least yellow, magenta and cyan color toners;

a belt moving endlessly and used for sequentially transferring the toner images formed on said photosensitive members;

a plurality of rollers for tensioning the belt;

an oscillation motor attached to a drive shaft of a drive roller among said plurality of rollers; and transfer means opposed to said photosensitive members disposed side-by-side in a shifting direction of said belt.

13. A color image forming apparatus according to claim 12, wherein the color toners having four colors including yellow, magenta, cyan and black.

14. A color image forming apparatus according to claim 12, wherein said belt is a transfer material convey belt for supporting and conveying the transfer material, and the toner images formed on said photosensitive members are sequentially transferred onto the transfer material on said belt.

15. A color image forming apparatus according to claim 12, wherein the toner images formed on said photosensitive members are sequentially transferred onto said belt, and, thereafter, the toner images are transferred onto the transfer material collectivey.

16. A color image forming apparatus according to claim 12, wherein convey means for the transfer material conveyed by another drive means is/are disposed upstream or downstream or upstream and downstream of said belt in a shifting direction of said belt.

17. A color image forming apparatus according to claim 12, wherein said convey means for the transfer material conveyed by said another drive means disposed upstream of said belt in the shifting direction of said belt is a transfer material supply means for supplying the transfer material one by one from a transfer material containing portion to said belt.

18. A color image forming apparatus according to claim 12, wherein said convey means for the transfer material conveyed by said another drive means disposed downstream of said belt thereof in the shifting direction is a convey means for conveying the transfer material separated from said belt to a fixing means disposed at the downstream side of said belt in the shifting direction thereof.

19. A color image forming apparatus according to claim 12, wherein said convey means is a fixing device for pinching and driving the transfer material.

* * * * *

UNITED STATES PATENT AND TRADEMARK OFFICE

CERTIFICATE OF CORRECTION

PATENT NO. : 5,950,059

DATED : September 7, 1999

INVENTOR(S) : HIROSHI SAHARA

It is certified that error appears in the above-identified patent and that said Letters Patent is hereby corrected as shown below:

COLUMN 1

Line 43, "loosing" should read --loosening--.

COLUMN 2

Line 10, "in" (second occurrence) should read --for--;
Line 38, "why" should read --for--; and
Line 55, "denotes" should read --denote--.

COLUMN 5

Line 19, "resist" should read --regist--;
Line 25, "in synchronous" should read --synchronously--;
Line 57, "that" should read --so that-- and "does not act" should read --acts--; and
Line 58, "less" should read --little--.

UNITED STATES PATENT AND TRADEMARK OFFICE

CERTIFICATE OF CORRECTION

PATENT NO. : 5,950,059

DATED : September 7, 1999

INVENTOR(S) : HIROSHI SAHARA

It is certified that error appears in the above-identified patent and that said Letters Patent is hereby corrected as shown below:

COLUMN 7

Line 14, "motor" should read --motor,--.

COLUMN 8

Line 32, "collectivey." should read --collectively.--; and
Line 65, "collectivey." should read --collectively.--.

COLUMN 10

Line 13, "collectivey." should read --collectively.--.

Signed and Sealed this

Fifteenth Day of August, 2000

*Attest:*

*Attesting Officer*

Q. TODD DICKINSON

*Director of Patents and Trademarks*